United States Patent [19]

Hill

[11] Patent Number: 4,466,581

[45] Date of Patent: Aug. 21, 1984

[54] CABLE HOLDER

[76] Inventor: John O. Hill, 208 Cherrie Ave., Sherwood, Ark. 72116

[21] Appl. No.: 466,524

[22] Filed: Feb. 15, 1983

[51] Int. Cl.[3] ..... B65H 75/40

[52] U.S. Cl. ..... 242/96; 242/100.1

[58] Field of Search ..... 242/100.1, 96, 86.1, 242/107.1, 107.11, 107.12, 107.13, 107.14, 107.15; 191/12.4; 339/5 RL, 119 C, 147 C

[56] References Cited

U.S. PATENT DOCUMENTS

| | | | |
|---|---|---|---|
| 3,337,695 | 8/1967 | Brown | 242/107.13 X |
| 3,601,331 | 8/1971 | Frey | 242/107.11 |
| 3,837,448 | 9/1974 | Hagstrom | 191/12.4 |
| 3,853,285 | 12/1974 | Woodring | 242/107.11 |
| 4,006,952 | 2/1977 | Puckett | 242/107.13 X |
| 4,282,954 | 8/1981 | Hill | 242/96 X |

*Primary Examiner*—John M. Jillions

*Attorney, Agent, or Firm*—Hill, Van Santen, Steadman & Simpson

[57] ABSTRACT

A portable device for reeling in and paying out cables, such as jumper cables, which includes a casing, a pair of annular housing elements mounted for rotation relative to the casing, each of the annular housing elements having central hub portions which abut and are locked together for joint rotation. A groove is provided between the abutting faces of the hub portions in which there is received the central portion of each of the two jumper cables or the like. These cables are held together in the groove in clamped relation. Openings are provided in opposite sides of the casing for cables entering and leaving the casing, and suitable anchoring means may be provided in the interior of the casing to lock the clips on the ends of the cables interiorly of the casing to prevent dangling.

4 Claims, 6 Drawing Figures

FIG. 3
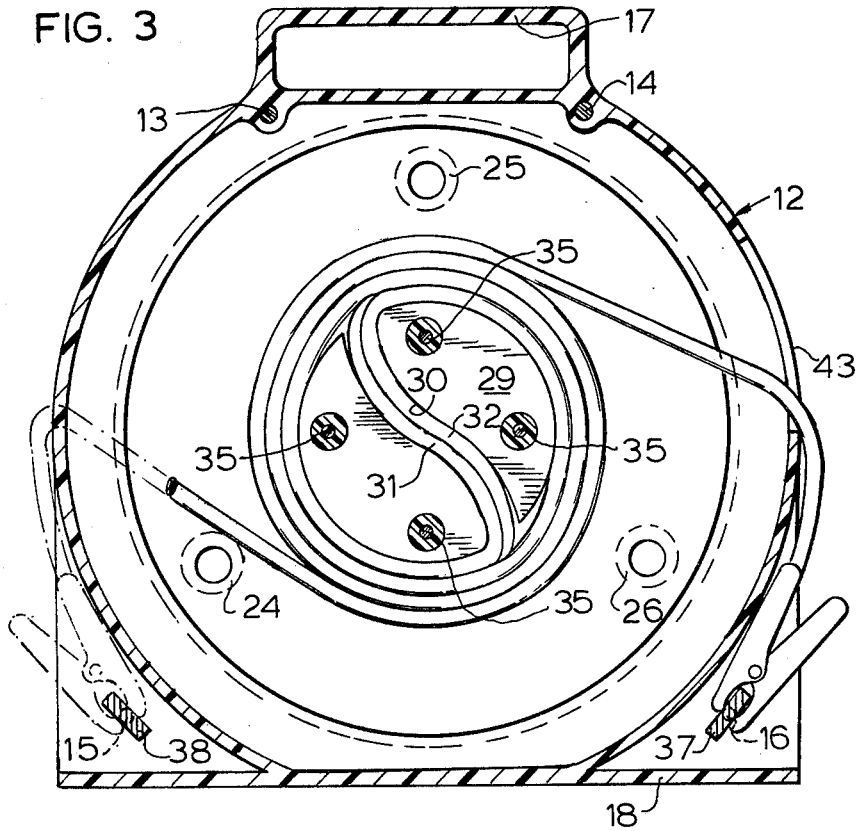
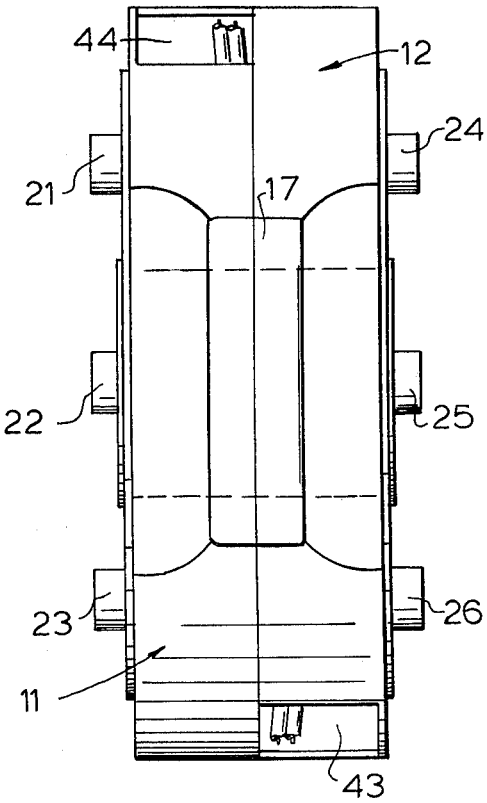
FIG. 4
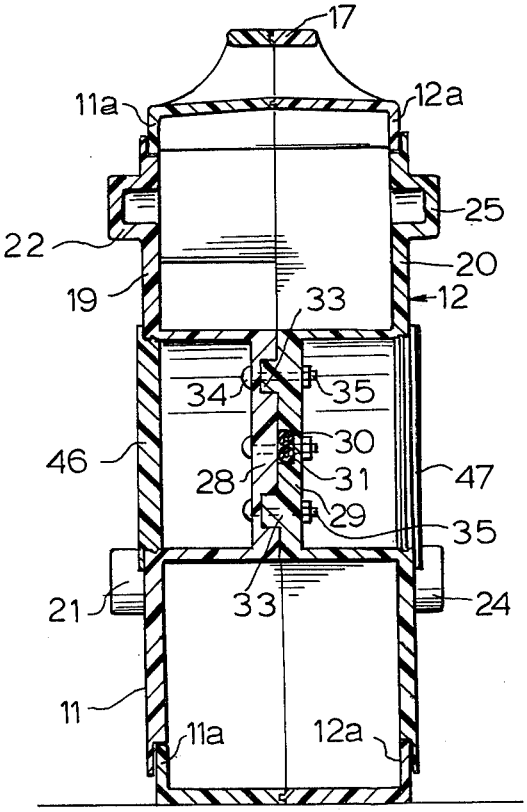
FIG. 5

CABLE HOLDER

BACKGROUND OF THE INVENTION

1. Field of the Invention

The present invention is in the field of portable devices for storing and dispensing two wire cables such as jumper cables to provide a compact package which protects against cable tangling and is particularly suitable for carrying in the trunk of an automobile.

2. Description of the Prior Art

A substantial number of motorists carry jumper cables in the trunks of their cars, in anticipation of requiring an additional voltage source due to a weak or dead battery. Such jumper cables conventionally consist of relatively heavy gauge wire, one normally being colored red and the other black, with alligator type clips at the ends of both cables to interconnect the terminals of the weak battery to terminals of a live battery. Being relatively thick, such cables are rather difficult to store in a limited space in the trunk and always present a tangling problem.

This application has some features in common with my previous U.S. Pat. No. 4,282,954, issued Aug. 11, 1981, and entitled "Rewinder Device".

SUMMARY OF THE INVENTION

The present invention provides a portable reel for storing and paying out cables such as jumper cables used to supplement the voltage output of a car battery. This device includes a casing which is preferably made of two pieces which mate to provide a handle at the top end and a flat, platform type base at the bottom. Rotatively disposed within the casing are a pair of housings or plates each of which has a central hub portion arranged to be received in abutting relationship. A driving connection is established between the two hub portions by including, for example, spaced lugs on one portion and sockets which receive the lugs on the other. Formed at the interface between the two hub portions is a groove wide enough to receive the central portions of the two cables in tight engagement when the two hub portions are interconnected. The free ends of the cables extend out from the casing by suitable openings on opposite sides of the casing. Thus, as the hub portions and their associated housings are rotated relative to the casing, the free ends of the cables are drawn simultaneously into the interior of the casing, between the hubs and the inner wall of the casing. Anchoring means are also provided within the casing on which the alligator type clips which are normally used on jumper cables can be secured to prevent dangling and also to keep any foreign matter which has accumulated on the clips from falling into the automobile trunk in which the portable reel will normally be stored.

BRIEF DESCRIPTION OF THE DRAWINGS

The invention is illustrated in conjunction with the attached sheet of drawings in which:

FIG. 2 is an end view of the device with the jumper cables reeled in;

FIG. 3 is a view taken substantially along the line III—III of FIG. 2;

FIG. 4 is a plan view of the reel device;

FIG. 5 is a cross-sectional view taken through the center of the device.

DESCRIPTION OF THE PREFERRED EMBODIMENTS

Figure 1:
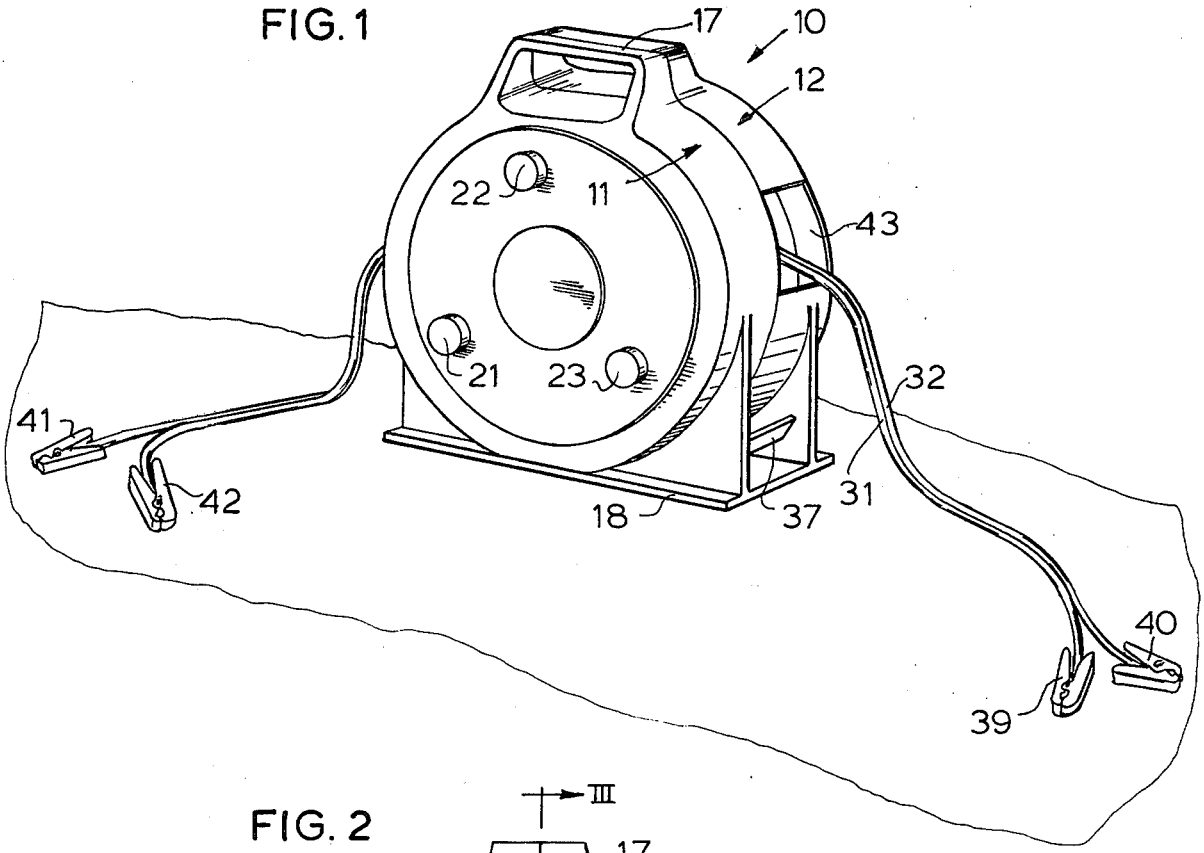
FIG. 1 is a view in perspective of a portable reel device according to the present invention, with the jumper cables extended out of the casing.
Figure 2:
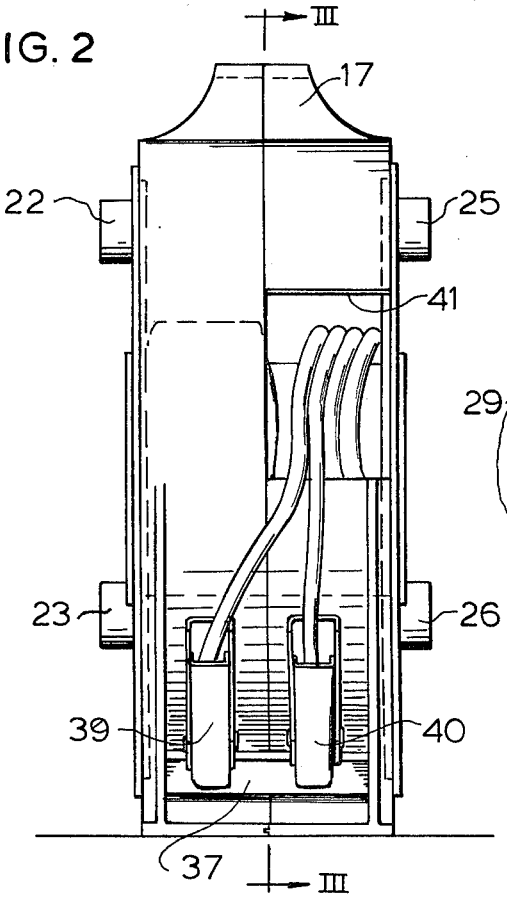

In FIG. 1, reference numeral 10 indicates generally a portable reel embodying the improvements of the present invention. The reel includes a pair of mating casing sections 11 and 12 composed of a plastic material or the like and held together by fastening means such as screws 13 through 16, respectively. At the top, the two mating sections form a handle 17 while at the bottom they form a relatively wide platform type base 18 enabling the reel to be seated firmly on the ground.

The two sections 11 and 12 have radially inwardly extending flange portions 11*a* and 12*a*, respectively, which provide bearing surfaces for rotatable housing members consisting of plates 19 and 20. The perimeter of the plates is suitably notched as indicated in FIG. 5 to be accommodated against the flange portions 11*a* and 12*a*, respectively. Each of the plates is formed with three protuberancs 21, 22, and 23 on plate 19 and 24, 25, and 26 on plate 20, these protuberances forming handles by means of which the housing sections can be rotated relative to the casing.

Figure 6:
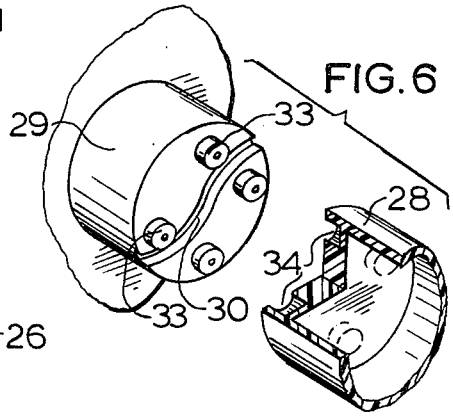
FIG. 6 is a fragmentary exploded view illustrating the manner in which the hub sections cooperate.

Centrally of the housing structures are hub sections 28 and 29, respectively. As best illustrated in FIGS. 3 and 6, on the face of the hub section 29 there is formed a generally S-shaped groove 30 which is of sufficient width to tightly receive two cables 31 and 32 therein. It will be recognized, of course, that the groove can be formed in either hub section or that it can be formed from a combination of two mating grooves, one on each section. The hub sections are interlocked by providing spaced lugs 33 (FIG. 5) which are received in lug engaging sockets 34 in the hub portion 28. The lugs and sockets are rigidly secured together by nut and bolt assemblies 35 illustrated in both FIGS. 3 and 5. This rigid connection serves to clamp the central portions of the cables 30 and 31 securely within the center of the reel.

Extending between the side walls of the casing structure beyond the perimeter of the annular housing sections at the opposite side of the casing are two storage spaces. Respectively mounted in the storage spaces between the side walls are anchoring strips 37 and 38. These strips are held between the casing walls by means of the aforementioned screws 15 and 16. The anchoring strips 37 and 38 serve to provide a means for securing alligator clips 39, 40, 41 and 42 which are conventionally provided at the ends of a jumper cable. This prevents unraveling and also serves to minimize the danger of residue, ie. corrosion products or the like, which may appear on the clips from dropping onto the floor of the car trunk where the reel device would normally be kept.

The cables 30 and 31 exit the casing through openings 43 and 44.

Access to the central hub portion of the reel is provided through a pair of removable caps 46 and 47 as shown in FIG. 5.

The improved reel of the present invention can be marketed as a reel with or without the jumper cables being provided. In case the user provides his own cables, it is a simple matter to fit the central portions of the cables into the S-shaped curve 30, tighten the nut and bolt assemblies 35 and then wind up the cables through the openings 43 and 44 by rotating the housing sections relative to the stationary casing. This results in winding the free ends of the two cables simultaneously, and when the alligator clips at the ends of the cables have been reached, it is a simple matter to fix the ends of these cables on the strips 37 and 38 thereby providing a neat, non-tangling package which is compact enough to fit in a very small space in the car trunk.

It should be evident that various modifications can be made to the described embodiments without departing from the scope of the present invention.

I claim as my invention:

1. A portable reel-in device for jumper cables having alligator-type clips on both ends of each cable comprising:

a casing having a flat base, a first annular housing section being mounted for rotation relative to said casing and having a central hub portions, a second annular housing section mounted for rotation relative to said casing and having a second central hub portion, said two central hub portions having engageable portions arranged to engage each other in locked relation while provided a groove therebetween into which central portions of the cables can be received in tight engagement, securing means locking said two hub portions together, means defining openings on opposite sides of said casing for directing said cables into and out of the interior of said casing, a pair of opposed, parallel extending sidewalls in said casing disposed between said annular housing sections and said base at each opposite side of said casing for defining storage spaces overlying said base and respectively beneath said openings, and anchoring means extending between said sidewalls of each said storage space for being engaged by said alligator clips on the corresponding ends of said jumper cables such that said alligator clips are securely stored and residue from said alligator clips is contained in said casing.

2. A device according to claim 1 in which:

said engageable portions consist of lugs on one of said central hub portions and lug-receiving sockets on the other of said central hub portions.

3. A device according to claim 1 which includes: an integral handle formed in said casing.

4. A device according to claim 1 in which: said casing is formed of two mating sections, and fastening means securing said sections together.

* * * * *